US005975963A

United States Patent [19]

Higuchi et al.

[11] Patent Number: 5,975,963

[45] Date of Patent: Nov. 2, 1999

[54] FEMALE TERMINAL

[75] Inventors: Mitsutoshi Higuchi; Toshikazu Mizutani; Satoru Imaeda; Yasuo Miyake; Takehiko Niwa; Haruo Shimura, all of Aichi, Japan

[73] Assignee: Kabushiki Kaisha Tokai Rika Denki Seisakusho, Aichi, Japan

[21] Appl. No.: 09/091,904

[22] PCT Filed: Dec. 24, 1996

[86] PCT No.: PCT/JP96/03827

§ 371 Date: Jun. 26, 1998

§ 102(e) Date: Jun. 26, 1998

[87] PCT Pub. No.: WO97/24910

PCT Pub. Date: Jul. 10, 1997

[30] Foreign Application Priority Data

Dec. 28, 1995 [JP] Japan ..... 7-353247

[51] Int. Cl.[6] ..... H01R 11/22

[52] U.S. Cl. ..... 439/851; 439/83

[58] Field of Search ..... 439/851, 876, 439/83

[56] References Cited

U.S. PATENT DOCUMENTS 3,368,188 2/1968 Olsson ..... 439/876
3,601,786 8/1971 Brubaker ..... 439/876
3,717,841 2/1973 Mancini ..... 439/876

FOREIGN PATENT DOCUMENTS 64-29793 2/1989 Japan .
1-60573 4/1989 Japan .
2-5497 1/1990 Japan .

*Primary Examiner*—Michael L Gellner
*Assistant Examiner*—Antoine Ngandjui
*Attorney, Agent, or Firm*—Morgan, Lewis & Bockius LLP

[57] ABSTRACT

A female terminal has a structure that does not allow molten solder to close a pipe section into which male terminal is inserted. Notched recessed sections (9) are oppositely formed at the lower ends of the side faces (3*a* and 3*a*) of a female terminal (1). The female terminal (1) is locked by horizontally opening locking legs (7) protruded from the rear surface of a printed wiring board (11) from an inserting hole (12). In such a state, the rear surface of the board is dipped in molten solder (21). When the board (11), is pulled up from the molten solder (12), the solder (21) closing the pipe section (2) in a bridge-like form is turned to droplets and drops from the recessed section (9), because the wettability of the pipe section (2) with the solder (21) is lowered and the adhesion is weakened due to the recessed sections (9). The remaining molten solder (21) attaches to the peripheral edge of the end of the pipe section (2) other than the recessed sections (9) due to the surface tension and solidifies.

6 Claims, 3 Drawing Sheets

FEMALE TERMINAL

TECHNICAL FIELD

This invention relates to an improvement of a female terminal.

BACKGROUND ART

When, in order to secure a female terminal a to a mounting (inserting) hole c formed in a printed wiring board b, the board is dipped in a molten solder with a male-terminal inserting cylindrical portion d suitably locked, sometimes as shown in FIG. 4 the molten solder e on the edge of the mounting hole spreads to close the cylindrical portion d in a bridge-like form, and solidifies.

In view of the foregoing, an object of the invention is to provide a female terminal which is so designed in structure that the molten terminals will never close the male-terminal inserting cylindrical portion.

DISCLOSURE OF THE INVENTION

The foregoing object of the invention has been achieved by the provision of a female terminal which, with a male terminal inserting cylindrical portion thereof fixedly inserted in a mounting hole formed in a printed wiring board, is secured to the mounting hole; in which, according to the invention, the end part of the cylindrical portion has at least a pair of notched recesses which are confronted with each other.

The above-described female terminal has at least a pair of notched recesses. Therefore, the molten solder 21, which otherwise spreads in a bridge-like form to close the cylindrical portion, is lowered in conformability; that is, its sticking force is decreased, so that it is dropped from the notched recesses. The remaining molten solder on the cylindrical portion is shifted towards the edges of the cylindrical portion except for the notched recesses by the surface tension thereof, and solidified. Therefore, the cylindrical portion, into which the male terminal is to be inserted, is not closed by the solder, yet the female terminal is fixedly mounted on the printed wiring board. This feature contributes to the improvement of productivity.

PREFERRED EMBODIMENT OF THE INVENTION

Figure 1:
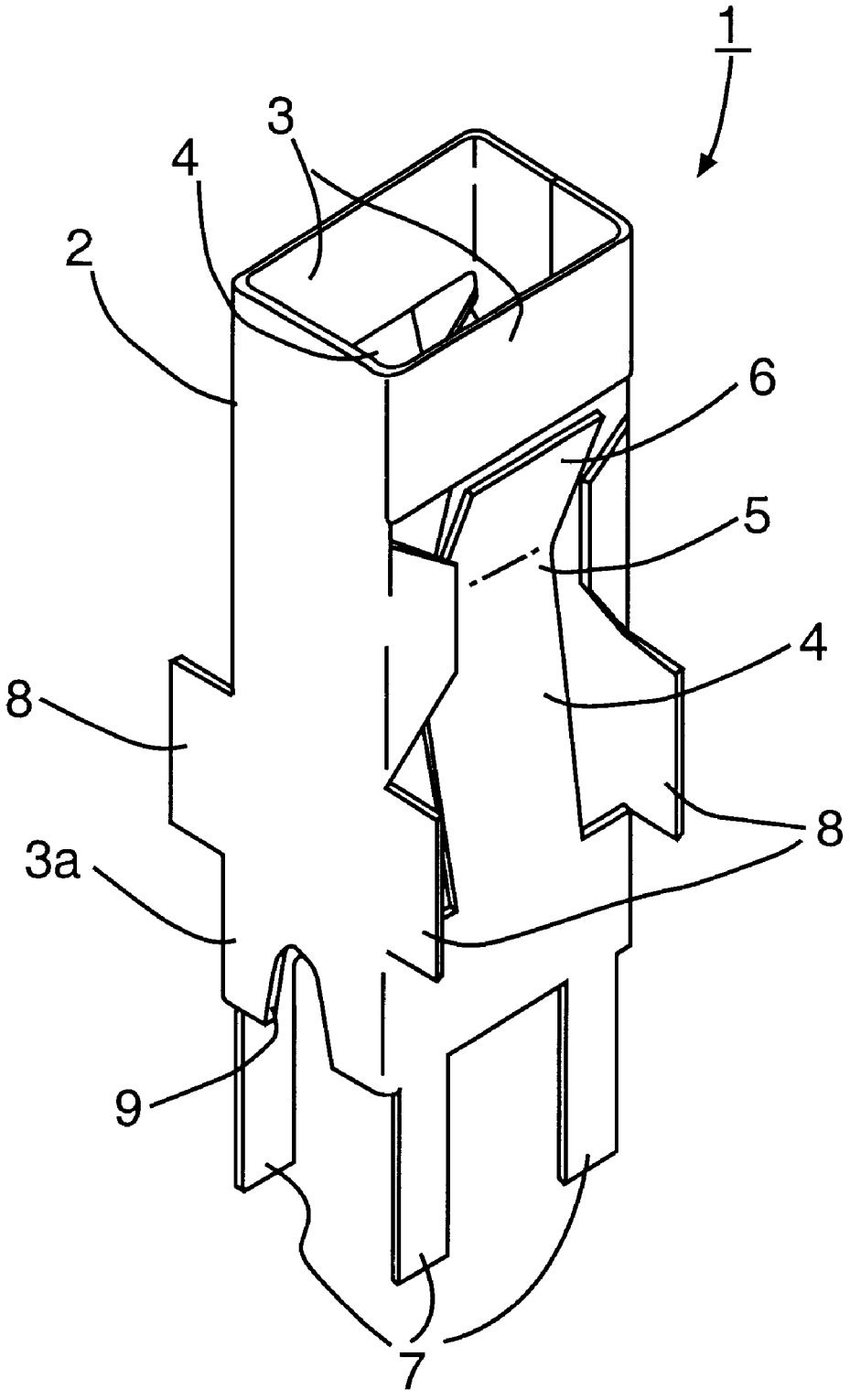
FIG. 1 is a perspective view of a female terminal 1, which constitutes a preferred embodiment of the invention.
Figure 2:
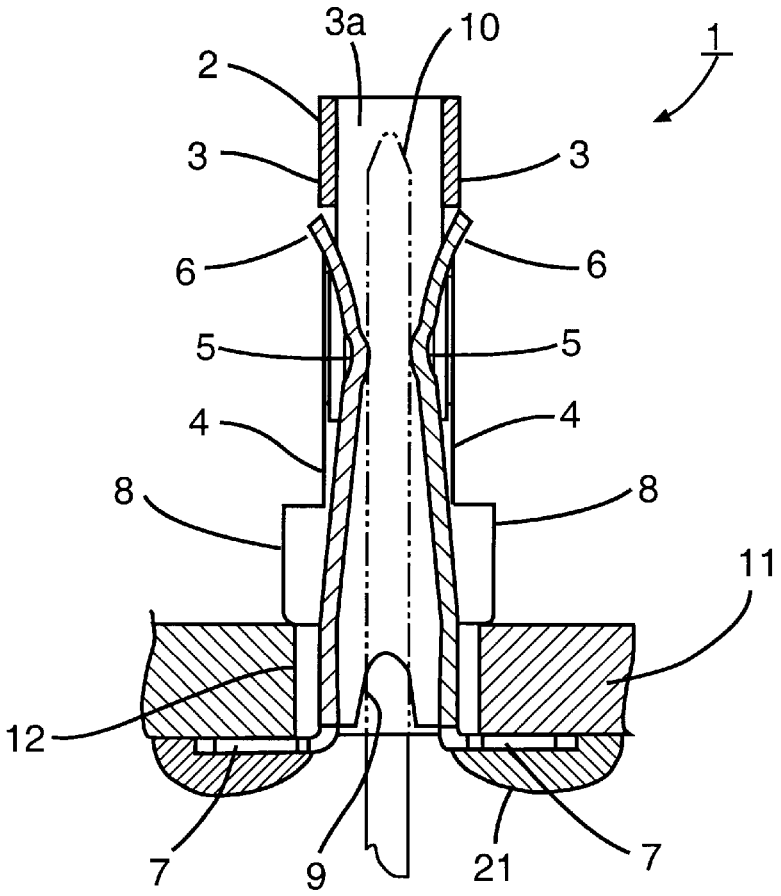
FIG. 2. is a sectional view showing the female terminal 1 which is mounted on a printed wiring board.
Figure 3:
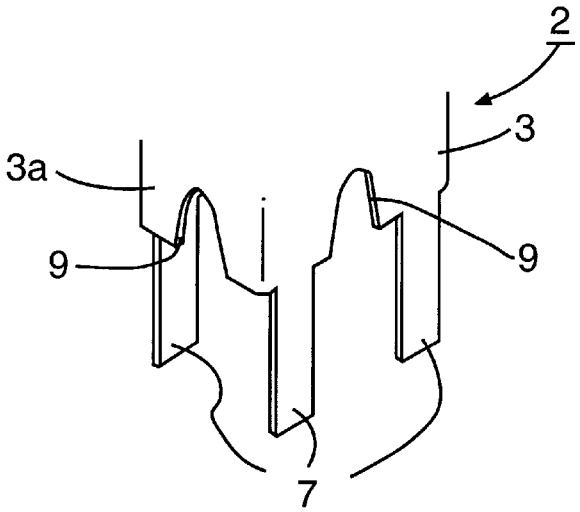
FIG. 3 is a perspective view of a cylindrical portion of one modification of the female terminal of the invention.
Figure 4:
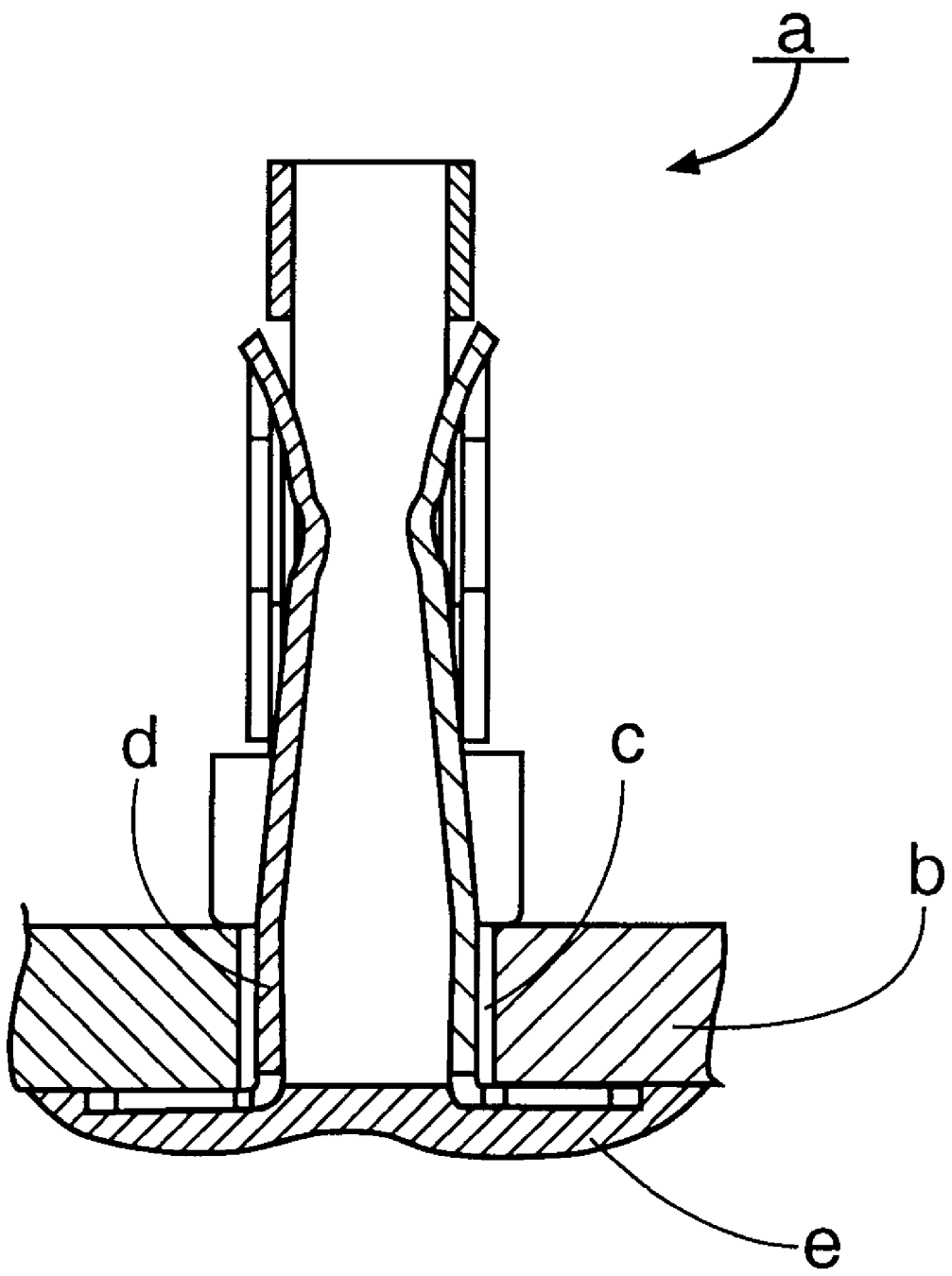
FIG. 4 is a sectional view of a conventional female terminal.

A female terminal, a preferred embodiment of the invention, will be described with reference to the accompanying drawings. FIG. 1 is a perspective view of the female terminal 1 according to the invention; FIG. 2 is a sectional view showing the female terminal 1 which is mounted on a printed wiring board; FIG. 3 is a perspective view of a cylindrical portion of one modification of the female terminal of the invention; and FIG. 4 is a sectional view of a conventional female terminal. The female terminal 1 is formed on a progressive press machine. That is, a conductive metal hoop material is punched into a part in a predetermined form, and the part thus obtained is bent. This bending work forms a vertically elongated cylindrical portion 2, into which a male terminal 10 is inserted.

The side surfaces 3 and 3 which are extended longitudinally in such a manner as to confront with each other, have clamping elastic pieces 4 and 4, respectively. The clamping elastic pieces 4 and 4 are formed as follows: That is, the clamping elastic pieces 4 and 4 have clamping portions 5 and 5 at the middle, and end portions 6 and 6 extended upwardly from the clamping portions 5 and 5. The clamping elastic pieces 4 and 4 are bent towards each other in such a manner that the distance between the clamping elastic pieces 4 and 4 are gradually smaller towards the clamping portions 5; i.e., it is smallest at their clamping portions 5 and 5, and the end portions 6 and 6 are inclined outwardly. A pair of side surfaces 3 and 3 of the cylindrical portion 2 which are confronted with each other, have two pairs of locking legs 7 (four locking legs 7) extended from their edges, respectively, in such a manner that they are confronted with each other. The remaining side surfaces 3*a* and 3*a* of the cylindrical portion have a pair of wing-shaped pieces 8 and 8, respectively, at a level corresponding to the thickness of a printed wiring board 11 (described later). In addition, the side surfaces 3*a* and 3*a* have notched recesses 9 and 9 in their lower end portions, respectively, in such a manner that the recesses 9 and 9 are confronted with each other.

The above-described female terminal 1 is installed as follows: The lower end of the cylindrical portion is inserted into a mounting hole 12 formed in the printed wiring board 11 until the lower ends of the wing-shaped pieces 8 are abutted against the edge portion of the mounting hole 12. Under this condition, the locking legs 7 which are protruded from the rear surface of the printed wiring board 11, are bent horizontally, to lock the female terminal 1. Under this condition, the rear surface of the printed wiring board 11 is dipped in a molten solder 21. In this operation, the molten solder sticks onto the locking legs 7 and spreads into the lower part of the cylindrical portion 2, thus closing the lower opening of the cylindrical portion 2 in a bridge-like form. The parts other than the mounting hole which need no soldering process has been subjected to solder resist printing.

Thereafter, the printed wiring board 11 is pulled up from the molten solder 21. In this operation, since the cylindrical portion has the notched recesses 9, the molten solder 21 with respect to the cylindrical portion 2 is lowered in conformability; that is, its sticking force is decreased, so that it is dropped from the notched recesses 9. The remaining molten solder 21 on the cylindrical portion 2 is shifted towards the edges of the cylindrical portion 2 except for the notched recesses 9 and 9 by the surface tension thereof, and solidified. Therefore, the cylindrical portion 2, into which the male terminal 10 is to be inserted, is not closed by the solder, yet the female terminal 11 is fixedly mounted on the printed wiring board 11. This feature contributes to the improvement of productivity.

In addition, the same notched recess 9 may be formed between the locking legs 7 of the side surfaces 3 and 3.

What is claimed is:

1. A female terminal to be secured into a mounting hole formed in a printed wiring board, comprising:

a male-terminal inserting portion;

a clamping elastic piece at a first side surface of the male-terminal inserting portion;

a plurality of locking legs formed at an end part of the male-terminal inserting portion for engaging with a bottom surface of the printed wiring board;

a plurality of wing-shaped pieces extended along a second side surface of the male-terminal inserting portion for engaging with a top surface of the printed wiring board; and wherein the end part of the male-terminal inserting portion includes at least a pair of notched recesses.

2. The female terminal according to claim 1, wherein the plurality of locking legs extend from the first side surface of the male-terminal inserting portion, and said at least a pair of notched recesses are formed on the second side surface of the male-terminal inserting portion.

3. The female terminal according to claim 1, wherein a distance between a bottom part of the plurality of wing-shaped pieces and a top part of the plurality of locking legs is equal to a depth of the printed wiring board so that the female terminal can be engaged securely with the printed wiring board.

4. The female terminal according to claim 1, further comprising at least a pair of clamping elastic pieces confronting each other.

5. The female terminal according to claim 1, wherein the plurality of locking legs are bent horizontally so as to be capable of being engaged with the bottom surface of the printed wiring board by using a molten solder.

6. The female terminal according to claim 5, wherein said at least a pair of notched recesses each have a size large enough so that the molten solder does not fill said at least a pair of notched recesses.

* * * * *